United States Patent [19]

Kitchen et al.

[11] 4,200,955

[45] May 6, 1980

[54] GIRDER ROLLER FITTINGS

[75] Inventors: Roger M. Kitchen, Sheffield; Dennis Braithwaite, Barnsley, both of England

[73] Assignee: Deborah Services Limited, Wakefield, England

[21] Appl. No.: 939,699

[22] Filed: Sep. 5, 1978

[30] Foreign Application Priority Data

Sep. 19, 1977 [GB] United Kingdom ..... 38959/77

[51] Int. Cl.[2] ..... E05D 13/02

[52] U.S. Cl. ..... 16/106; 182/150; 182/36

[58] Field of Search ..... 182/36, 37, 38, 39, 182/150; 16/91, 97, 98, 106, 107, 18, 46

[56] References Cited

U.S. PATENT DOCUMENTS

| | | | |
|---|---|---|---|
| 1,427,453 | 8/1922 | Fleming | 182/36 |
| 1,710,693 | 4/1929 | Davidson . | |
| 2,165,221 | 7/1939 | Burton . | |
| 2,538,434 | 1/1951 | Svendsen | 16/106 X |
| 3,066,757 | 12/1962 | Robinson et al. | 182/36 |
| 3,076,522 | 2/1963 | Goodell | 182/150 X |
| 3,096,064 | 7/1963 | Leonard . | |
| 3,851,729 | 12/1974 | Gordon | 182/36 |

FOREIGN PATENT DOCUMENTS

| | | | |
|---|---|---|---|
| 537808 | 6/1959 | Belgium | 182/36 |
| 829768 | 12/1969 | Canada | 182/36 |
| 2346523 | 10/1977 | France . | |

*Primary Examiner*—Nile C. Byers, Jr.
*Assistant Examiner*—Moshe I. Cohen
*Attorney, Agent, or Firm*—Schwartz & Weinrieb

[57] ABSTRACT

A roller fitting adapted to be secured to a length of scaffold tube and to suspend said scaffold tube from a girder, said fitting comprising a main body, a clamp pivotally mounted on the main body, means for releasably holding the clamp to the main body, and a roller rotatably mounted on part of the main body by means of a bearing. The clamp and main body are so shaped that they can receive and hold between them a length of scaffold tube and the arrangement is such that, when the fitting is located in position with the roller bearing on a flange of a girder, the said part of the main body on which the roller is mounted is located over the flange of the girder whereby, in the event of failure or breaking up of the roller or bearing, the said part can engage the flange of the girder.

9 Claims, 8 Drawing Figures

GIRDER ROLLER FITTINGS

BACKGROUND OF THE INVENTION

This invention relates to the attachment of scaffolding platforms, workmen's platforms or cradles to flanged girders of steel or like material and is particularly concerned with a roller fitting adapted to be secured to a length of scaffolding and to suspend said scaffolding from such girders.

One known arrangement for suspending a workmen's cradle is disclosed in British Pat. No. 1,045,146 in which the cradle is suspended from a tubular rail 28 by means of a strap 32 which is hooked around a rod 29 which in turn carries stub shafts 31 on which are rotatably mounted rollers 30 which engage the rail 28. With this arrangement, the rod 29 and rollers 30 must be located above the rail 28 and this arrangement cannot be used for suspending a platform from a girder having horizontally extending flanges because the strap would foul the outside edge of one of the flanges. Moreover, the rod 29 would have to be located above the girder and access to the top of a girder is usually not possible in practice.

Another arrangement for suspending a platform from a flanged girder is disclosed in British Pat. No. 776,642 in which rollers 24 are arranged to run along horizontal flanges extending from both sides of a girder or track 22. The two rollers 24 are mounted on a so-called traveller 21 which carries a pulley block 20 and the platform is suspended by a cable 19 from the pulley block. It is clear from this arrangement that both flanges of the girder must be engaged by rollers and that if one of the rollers were to be omitted the platform could not be reliably suspended from the girder and the traveller 21 could fall off the girder with possible fatal results for anyone standing on the platform at the time.

Moreover, in both of the above-described arrangements, the platform or cradle is suspended by ropes or cables which are prone to breakage and cannot therefore be regarded as being absolutely safe.

SUMMARY OF THE INVENTION

The object of the present invention is to provide a roller fitting by means of which a platform or cradle can be safely suspended from a flanged girder even in cases where access to the top of the girder is not possible and in which only one side flange of the girder is engaged by a single roller of the said roller fitting.

A further object is to provide a roller fitting for a platform or cradle which permits said platform or cradle to be fitted directly to the roller fitting thereby eliminating the need for a rope or cable.

According to the invention, there is provided a roller fitting adapted to be secured to a length of scaffold tube and to suspend said scaffold tube from a girder, said fitting comprising a main body, a clamp pivotally mounted on the main body, means for releasably holding the clamp to the main body, said clamp and main body being so shaped as to receive and hold between them a length of scaffold tube, and a roller rotatably mounted on part of said main body by means of a bearing, the arrangement being such that, when the fitting is located in position with the roller bearing on a flange of a girder, said part of the main body on which the roller is mounted is located over the flange of said girder whereby, in the event of failure or breaking up of the roller or bearing, said part can engage the flange of the girder.

The main body and the clamp are desirably so arranged that the releasable clamp holding means is not subjected to any vertical load from the scaffold tube, this load being transferred directly to the main body.

The clamp is preferably mounted at one end on the main body, the other end of the clamp being provided with a slot. In this case, the releasable holding means preferably comprsies a bolt pivotably mounted on the main body and engageable in the slot in said clamp.

The roller is preferably at least partially spherical so that it can be used on both tapered and flat flanged girders. The bearing may be of the shell type which is desirably greased before assembly.

BRIEF DESCRIPTION OF THE DRAWINGS

The invention will now be further described, by way of example, with reference to the accompanying drawings in which.

In the drawings, like parts are denoted by like reference numerals.

DESCRIPTION OF PREFERRED EMBODIMENTS

Figure 1:
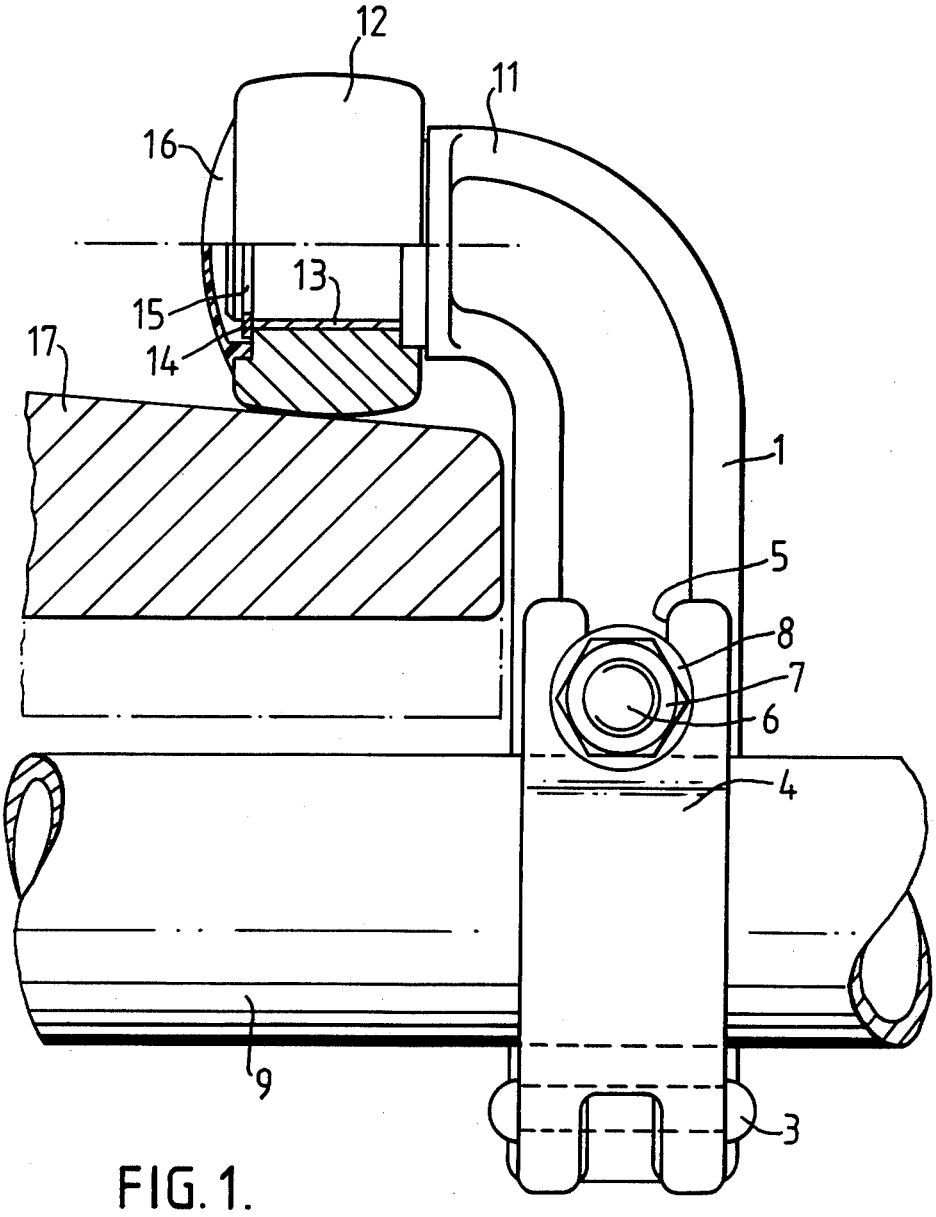
FIG. 1 is a part-sectional side elevation of one embodiment of a girder roller fitting according to the invention.
Figure 2:
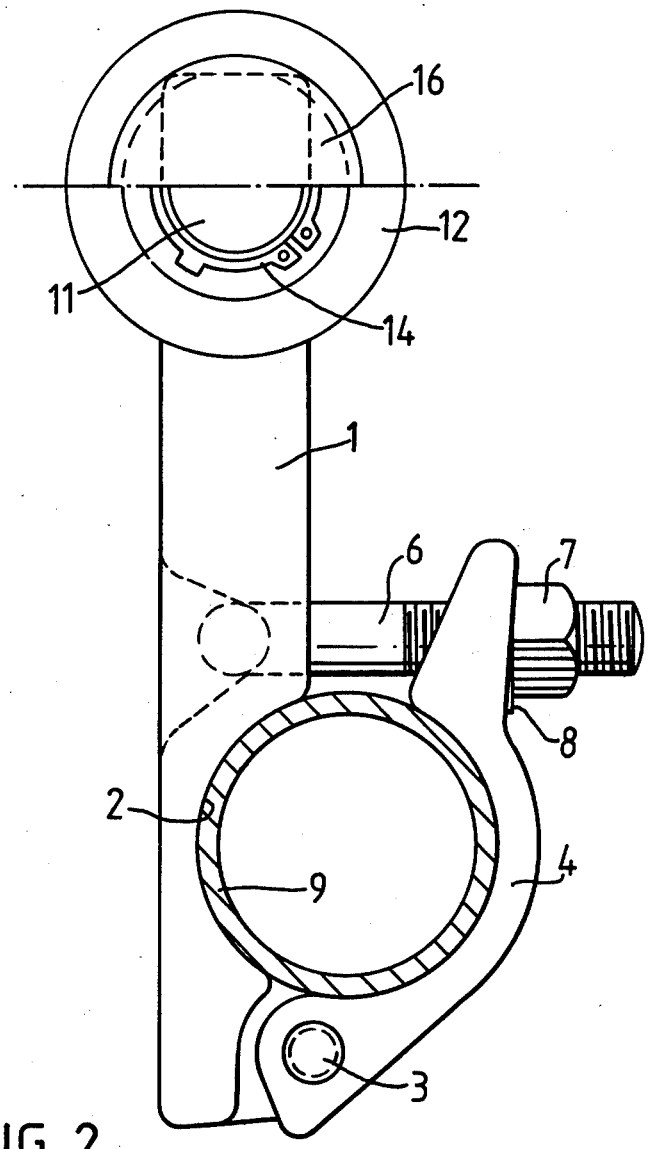
FIG. 2 is a front elevation of the fitting shown in FIG. 1.

Reference will first be made to FIGS. 1 and 2 of the drawings in which the fitting comprises a main body 1 having, adjacent one end, an arcuate recess 2 and on which one end of a latch or clamp 4 is pivotally mounted by means of a rivet 3. A latch bolt 6 is also pivotally mounted on the main body 1 and is receivable in a slot 5 in the other end of the clamp 4. The latch bolt 6 is screw-threaded along at least part of its length and a nut 7 and washer 8 are provided thereon.

The other end of the main body 1 is curved from the axis of the major portion of the length of said body and terminates in a part 11 extending substantially at right angles to said axis. Mounted on said part 11 is a partially-spherical roller 12 with a shell-type bearing 13 located between the body part 11 and the roller 12. A circlip 14 engaging in a groove 15 provided on the body part 11 serves to retain the bearing 13 and roller 12 on said body part. The bearing 13 is preferably greased prior to assembly on the body part 11 and a plastic end seal 16 fits over the end of the body part and is engageable with the bearing as shown in FIG. 1 to prevent the ingress of dirt and moisture to the bearing. Re-greasing of the bearing should only be necessary if the bearing is subjected to severe working conditions and excessively heavy loads. However, should re-greasing or replacement prove necesssary, it is a relatively simple matter to remove the end seal 16 and circlip 14 and thus dismantle the roller 12 and bearing 13 for cleaning and re-greasing or replacement.

In use, the fitting is secured to a length of scaffold tube 9 by engaging the arcuate recess 2 on said scaffold tube 9 and pivoting the clamp 4 into engagement with said scaffold tube. The latch bolt 6 is then allowed to drop into the slot 5 in the clamp 4 and the nut 8 turned until the body 1 and clamp 4 are clamped to the scaffold tube 9 in an immovable manner. The fitting is then ready for the roller 12 to be engaged on the flange 17 of a flanged girder as shown in FIG. 1.

Owing to the main body 1 being in a vertical plane, the vertical load from the scaffold tube 9 is transferred via the lug retaining the rivet 3 into the main body 1. By means of this arrangement, the latch bolt is only subjected to loads from the fitting being clamped onto the scaffold tube 9.

As can be seen in FIG. 1, the part 11 of the main body 1 of the fitting overhangs the flange 17 of the girder so that if the roller should break or come off the main body owing to bad handling the main body will still suspend the scaffolding. This represents an important safety feature of the fitting according to the invention.

Figure 3:
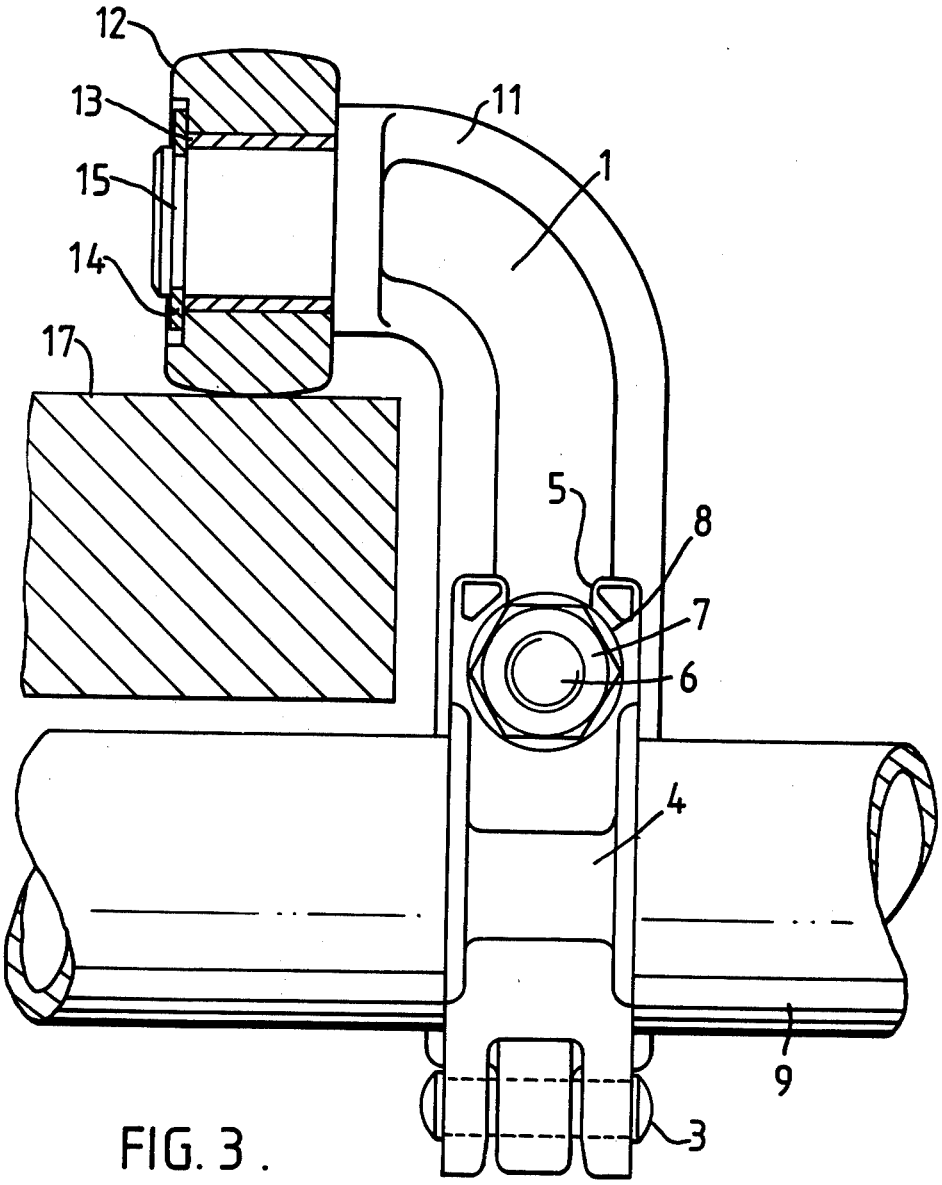
FIG. 3 is a part-sectional side elevation of a second embodiment of a girder roller fitting according to the invention.
Figure 4:
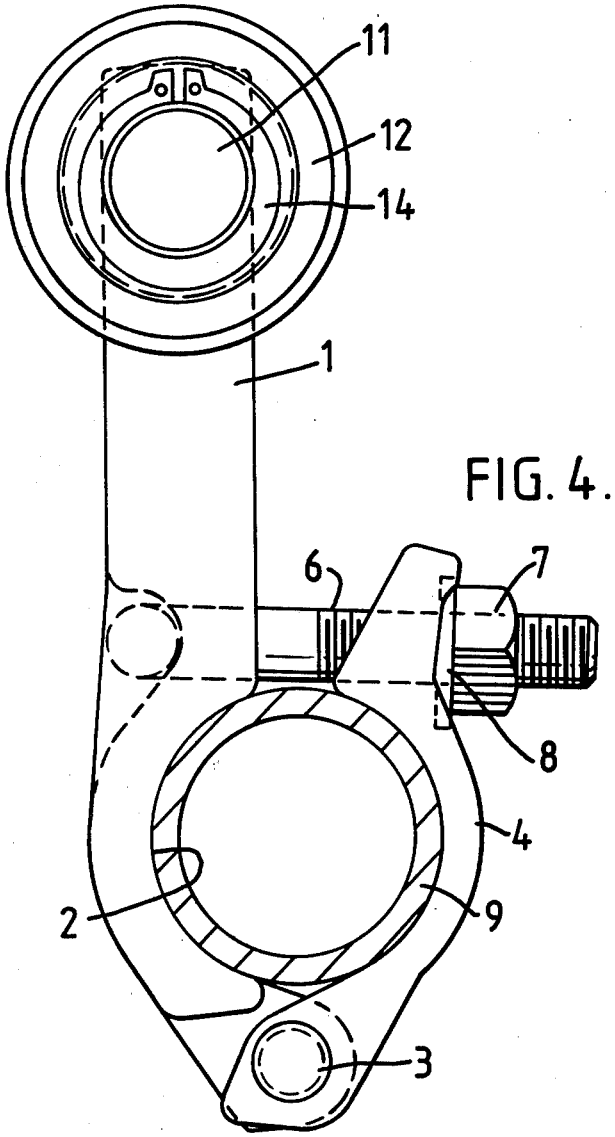
FIG. 4 is a front elevation of the fitting shown in FIG. 3.

The embodiment shown in FIGS. 3 and 4 is similar to the embodiment shown in FIGS. 1 and 2 of the drawings except for a few minor design modifications which are evident from a comparison of the drawings and further with the exception that the plastic end seal 16 is omitted in the embodiment shown in FIGS. 3 and 4. In the case of this embodiment, the bearing is packed with grease on assembly which prevents the ingress of dirt and moisture to the bearing.

In both embodiments, the main body 1 and latch or clamp 4 are preferably made of drop forged steel, the bolt 6 of mild steel and the roller 12 of cast iron or aluminium although other materials may be used if desired.

Figure 5:
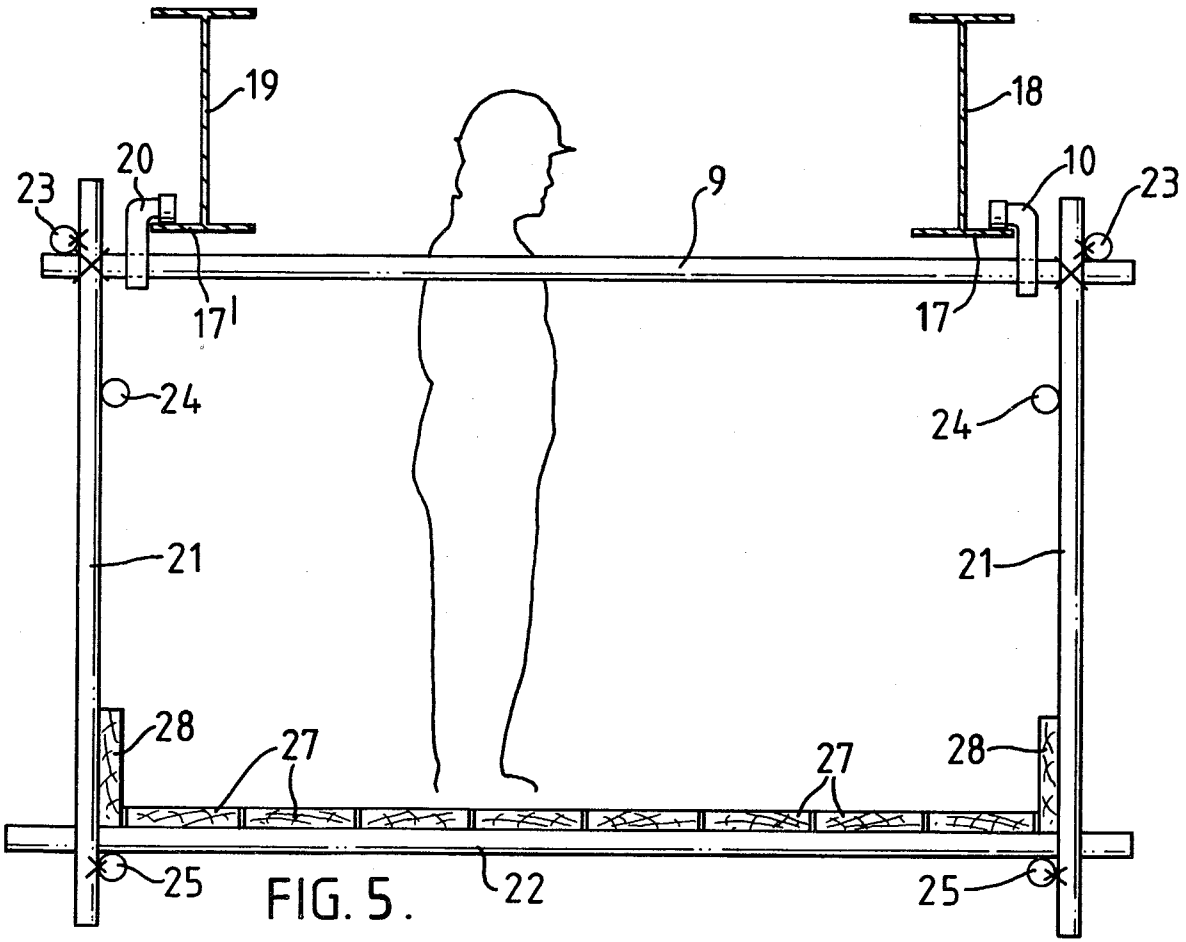
FIG. 5 shows the use of girder roller fittings according to the invention in the construction of a suspended scaffold platform.
Figure 6:
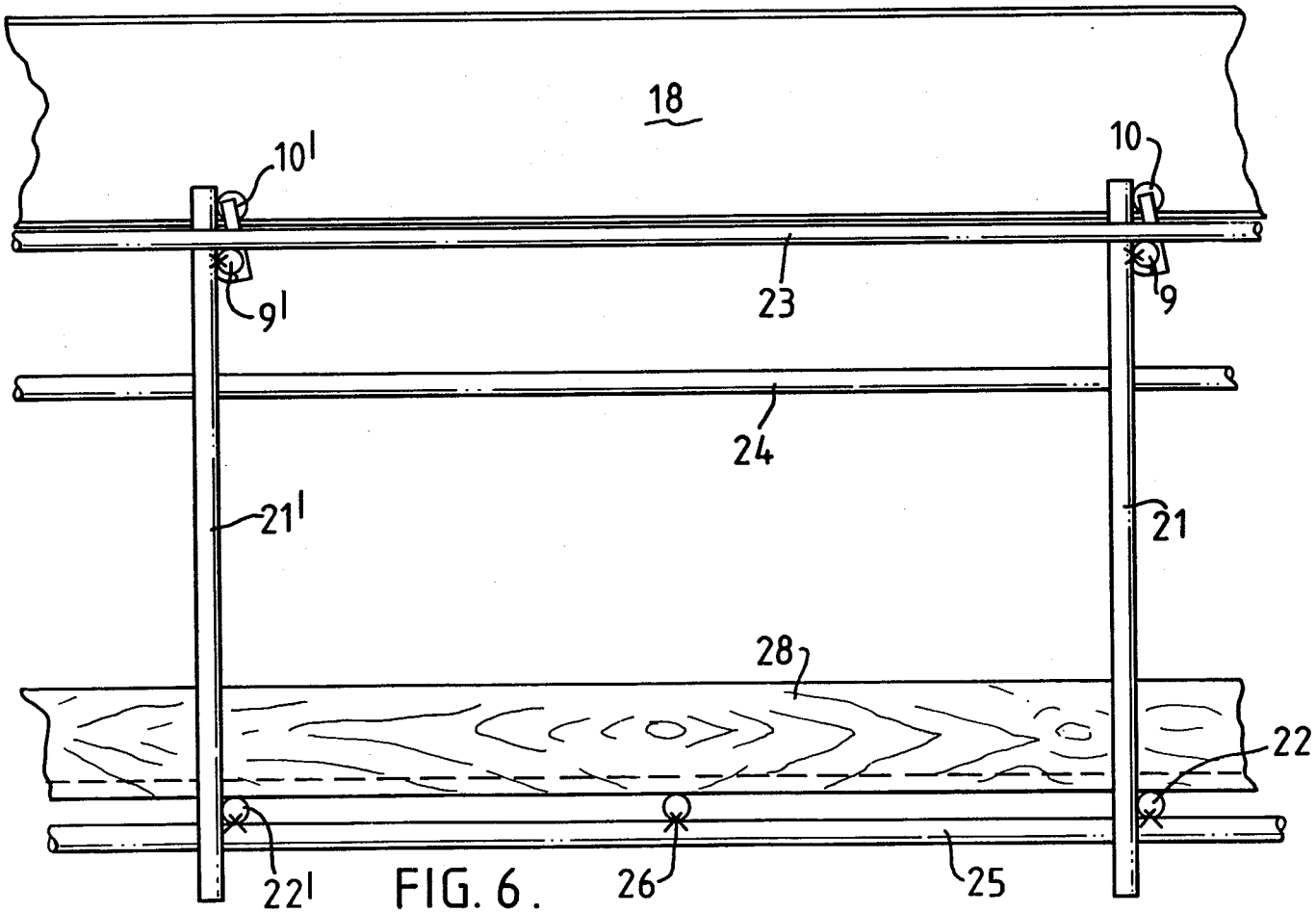
FIG. 6 is a side elevation of the suspended scaffold platform shown in FIG. 5.

FIGS. 5 and 6 of the drawings show the manner in which fittings according to the invention can be used in the construction of a suspended scaffold platform. A first fitting 10 is clamped onto a scaffold tube 9 of appropriate length. A second fitting 20 is loosely fitted onto the other end of the scaffold tube 9 and the first fitting 10 is then hooked over a flange 17 of a girder 18. The other fitting 20 is then slid along the scaffold tube 9 until its roller engages a flange 17' on a second girder 19 extending parallel to the girder 18. The fitting 20 is then clamped to the scaffold tube 9 so that the tube is prevented from moving sideways and can only move in a direction parallel to the girders 18 and 19.

A rectangular frame of scaffold tubes is built beneath the girders 18 and 19 by means of two vertical tubes 21 which are secured to either end of the scaffold tube 9 and a horizontal tube 22 connected to the vertical tubes 21 as shown in FIG. 5. Further scaffold tubes 23 and 24 are then secured to each vertical tube 21 and the frame is pushed along the girders for a suitable distance by means of the tubes 23 and 24. This distance will depend on the loadings to which the eventually constructed platform is to be subjected but will usually be in the region of eight feet.

A further scaffold tube 9' is then suspended from the girders 18 and 19 by means of a fitting 10' and a like fitting and another rectangular frame is built of a scaffold tubes 9', 21' and 22' in like manner to the frame above described. The scaffold tubes 23 and 24 are then secured to the vertical scaffold tubes 21'. The two frames are pushed out along the girders for a suitable distance by means of the tubes 23 and 24. The operations described above are repeated until the platform is pushed out the required distance.

All of the above operations are carried out from a permanent or previously erected platform in complete safety.

Temporary boards (not shown) are then laid on the horizontal tubes 22 and 22' to enable scaffold tubes 25 to be secured to the vertical tubes 21 and 21' and one or more scaffold tubes 26 to be secured to the scaffold tubes 25. The temporary boards may then be removed and replaced by boards 27 which form a working platform. Additional vertical boards 28 serve as toe boards and the scaffold tubes 24 serve as hand rails.

Figure 7:
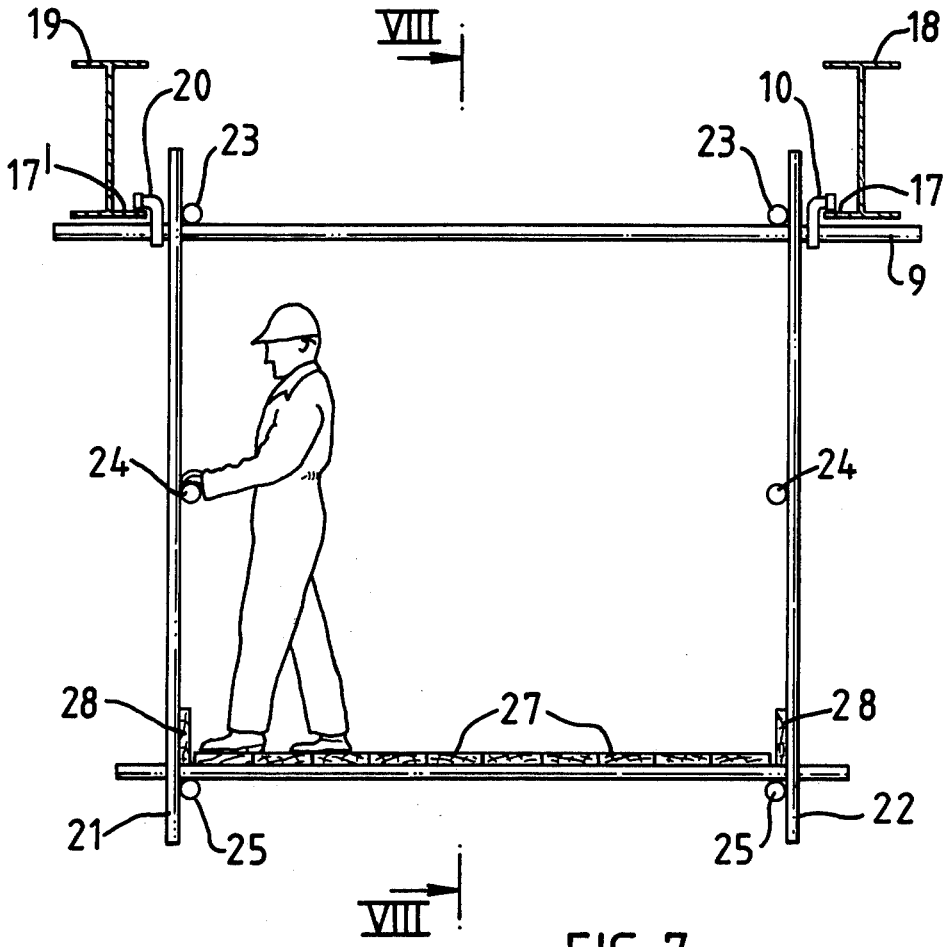
FIG. 7 shows the use of girder roller fittings according to the invention in the construction of a slightly modified suspended scaffold platform.
Figure 8:
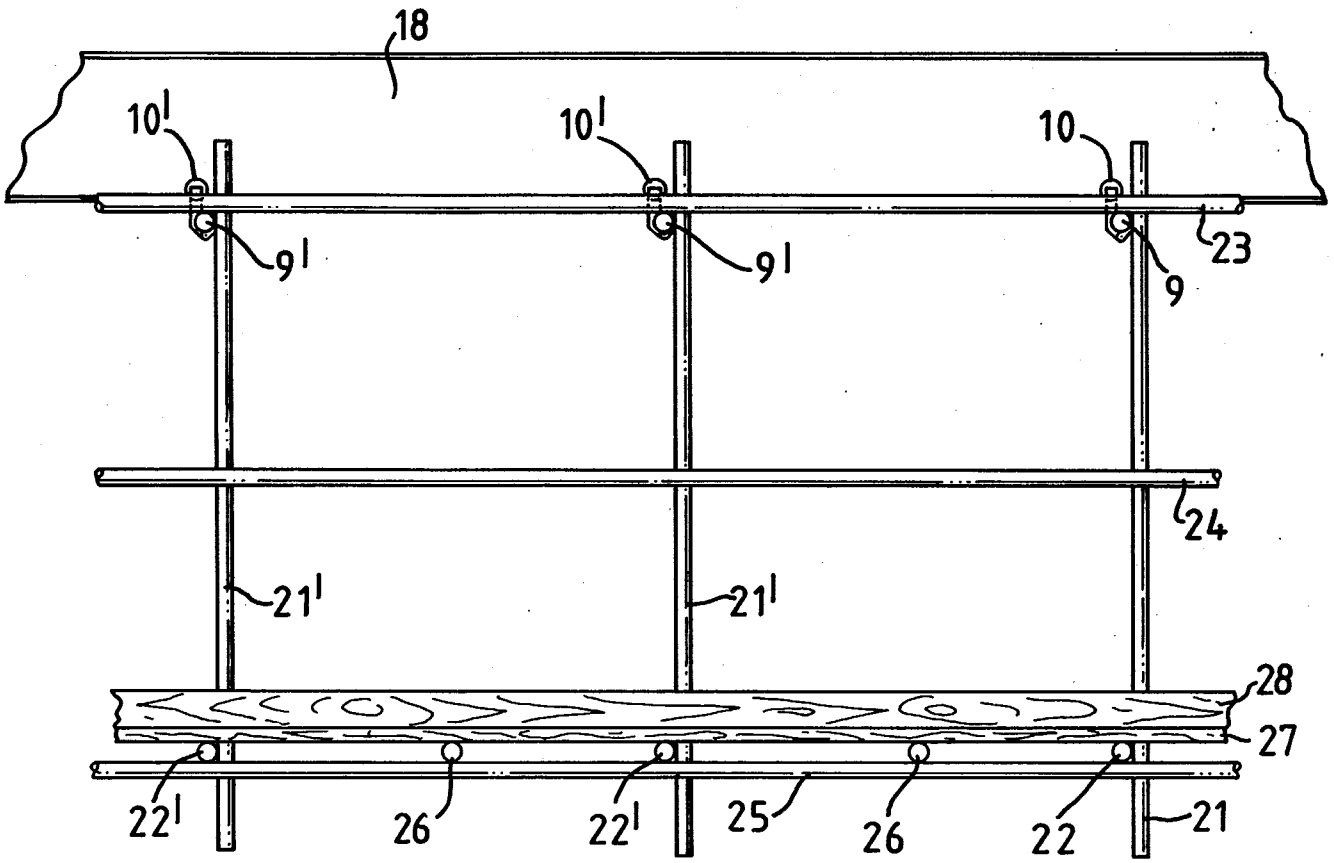
FIG. 8 is a section taken on the line VIII—VIII of FIG. 7.

FIGS. 7 and 8 show a suspended scaffold platform can be constructed in a slightly different manner using fittings according to the invention. In this case, the fittings 10 and 20 bear on the flanges 17 and 17' of the girders 18 and 19 which face towards one another. This arrangement is preferred because it has been found easier to locate the fittings on these flanges rather than the flanges used in FIG. 5. However, the arrangement shown in FIG. 5 may be preferred for some constructions.

In all other respects, the construction of the platform shown in FIGS. 7 and 8 proceeds in the same manner as that described with reference to FIGS. 5 and 6 and it will be noted that FIG. 8 shows a third frame of scaffold tubes 9', 21' and 22'. This frame and any additional frames are constructed in the manner above described.

It will be seen that, by means of the fitting according to the invention, standard equipment used throughout the scaffolding industry may be utilised to construct a movable working platform thus representing a considerable saving in special equipment which would otherwise be necessary.

Other embodiments and modifications of the above described roller fitting are possible without departing from the scope of this invention as defined by the appended claims.

We claim:

1. A roller fitting adapted to be secured to a length of scaffold tube for suspending said scaffold tube from a horizontal flange of a flanged girder, said fitting comprising:

a main body, the major length of which extends in the vertical direction;

a clamp pivotally mounted on said main body, said clamp and main body being so configured as to cooperatively receive and hold therebetween said length of scaffold tube, substantially horizontally disposed fastening means for releasably securing said clamp to said main body, a portion of said main body extending, at a position remote from the pivotal connection of said clamp, in a direction substantially perpendicular to the major length of said main body, said main body and clamp being secured to said scaffold tube at a position adjacent an edge portion of said girder flange such that said portion of said main body overlies the upper surface of said horizontal flange of said flanged girder, and a roller rotatably mounted on said portion of said main body by means of a bearing and operatively engaged with said upper surface of said horizontal flange of said flanged girder for rotatably suspending said scaffold tube from said girder, whereby, said fastening means is subjected to substantially zero vertical loading from said scaffold tube and, in the event of failure or break-up of said roller or bearing, said portion of said main body can engage the flange of said girder in a fail-safe manner.

2. A roller fitting as claimed in claim 1, in which the main body is provided with an arcuate recess adapted to receive and engage a portion of the scaffold tube, the clamp being pivotally mounted on the main body adjacent said arcuate recess.

3. A roller fitting as claimed in claim 1, in which the roller is at least partially spherical.

4. A roller fitting as claimed in claim 1, in which the roller bearing is of the shell type and is packed with grease on assembly.

5. A roller fitting as claimed in claim 1, in which the main body and clamp are made of drop forged steel.

6. A roller fitting as claimed in claim 1, in which the roller is made of cast iron.

7. A roller fitting as set forth in claim 1, further comprising:

seal means disposed over the free end of said roller for preventing the ingress of dirt and moisture into said bearing.

8. A roller fitting as claimed in claim 1, in which the clamp is pivotally mounted at one end on the main body, the other end of the clamp is provided with a slot and the releasable holding means comprises a bolt pivotally mounted on the main body and engageable in the slot in said clamp.

9. A roller fitting as claimed in claim 8, in which the head of the bolt is pivotally mounted in the main body and said bolt has a screw-threaded shank, a nut being engaged with the screw-thread and being effective, on being turned, to draw the said other end of the clamp towards the main body.

* * * * *